US007225939B2

(12) United States Patent
Casscles et al.

(10) Patent No.: US 7,225,939 B2
(45) Date of Patent: Jun. 5, 2007

(54) ASSYMETRIC HANDLEWARE CONTAINER HAVING HIDDEN GRIPPING APERTURE

(75) Inventors: Lorraine M. Casscles, Beacon, NY (US); Peter Bertolini, Shelton, CT (US); Robert Croft, Jersey City, NJ (US); Martin Short, Brooklyn, NY (US)

(73) Assignee: Conopco, Inc., Englewood Cliffs, NJ (US)

( * ) Notice: Subject to any disclaimer, the term of this patent is extended or adjusted under 35 U.S.C. 154(b) by 31 days.

(21) Appl. No.: 11/174,852

(22) Filed: Jul. 5, 2005

(65) Prior Publication Data

US 2007/0007236 A1 Jan. 11, 2007

(51) Int. Cl.
*B65D 23/10* (2006.01)

(52) U.S. Cl. ..... 215/398; 220/771

(58) Field of Classification Search ..... 215/384, 215/396–398, 395; 220/771; D9/453–514, D9/516–531
See application file for complete search history.

(56) References Cited

U.S. PATENT DOCUMENTS

| | | | | | |
|---|---|---|---|---|---|
| 3,270,922 | A | * | 9/1966 | Schmidt | 222/143 |
| D206,958 | S | | 2/1967 | Anderson | |
| D208,169 | S | | 7/1967 | Platte | |
| D210,443 | S | | 3/1968 | Mason, Jr. | |
| D212,210 | S | | 9/1968 | Anderson | |
| 3,434,635 | A | | 3/1969 | Mason, Jr. | |
| D221,516 | S | | 8/1971 | Crisci | |
| 4,658,975 | A | * | 4/1987 | Cone | 215/385 |
| D303,085 | S | * | 8/1989 | Mednis | D9/528 |
| D303,087 | S | * | 8/1989 | Gendron | D9/531 |
| D303,929 | S | | 10/1989 | Ross | |
| D311,136 | S | * | 10/1990 | Barker et al. | D9/531 |
| D318,228 | S | * | 7/1991 | Schlesselman | D9/531 |
| D323,981 | S | | 2/1992 | Satterfield | |
| 5,103,988 | A | * | 4/1992 | Reil et al. | 215/384 |
| 5,111,979 | A | | 5/1992 | Athar | |
| D329,816 | S | | 9/1992 | Beaver et al. | |
| D431,472 | S | * | 10/2000 | Cain et al. | D9/524 |
| D461,717 | S | | 8/2002 | Crawford et al. | |
| D471,465 | S | | 3/2003 | Sikra et al. | |
| D480,973 | S | * | 10/2003 | Nottingham et al. | D9/531 |
| D489,973 | S | * | 5/2004 | Root et al. | D9/415 |
| D498,420 | S | * | 11/2004 | Cadotte | D9/524 |
| 7,036,693 | B2 | * | 5/2006 | Walsh et al. | 222/572 |

* cited by examiner

*Primary Examiner*—Sue A. Weaver
(74) *Attorney, Agent, or Firm*—Michael P. Aronson

(57) ABSTRACT

A handleware container particularly useful for holding and dispensing liquid household products. The container includes a bottom wall panel; vertically oriented front, rear and opposing side wall panels; and a handle joining one of the side panels to form a gripping space; wherein the surface area of the front wall panel is larger than the surface area of the rear wall panel; and the gripping aperture is hidden from view by the front wall panel when the container is viewed orthogonal to the front wall panel.

5 Claims, 2 Drawing Sheets

ASSYMETRIC HANDLEWARE CONTAINER HAVING HIDDEN GRIPPING APERTURE

FIELD OF THE INVENTION

The present invention relates to a container for holding and dispensing liquids, particularly liquid household products that are displayed at point of sale.

BACKGROUND OF INVENTION

There is a growing trend to offer consumer products in larger sizes in discount and warehouse stores, and price clubs. Packaging that is designed for holding and dispensing liquid products require a handle when the package exceeds a certain capacity to make them practical for frequent use. Large volume containers used in such applications, especially for liquid products have evolved along two main lines.

Large capacity packages for commodity or industrial liquid products, e.g., mineral spirits, often have a facing that is rectangular in shape with a handle attached near a top of the container. The term facing refers to the overall viewable area within the silhouette of the container that is displayed to the consumer when the product is properly positioned on a supermarket shelf. This "brick shape" provides a large space for labels and graphics (essentially the entire facing) and allows efficient packing of the container on a supermarket shelf.

In contrast branded liquid products such as laundry detergents, fabric softeners, light duty liquids, dishwashing liquids, household liquid cleaners and shampoos for example, incorporate added value ingredient and functionality. The aesthetic qualities, i.e., style, ergonomic properties, and other features of the package contribute to brand differentiation. When viewed from a perspective orthogonal to the face panel, i.e., perpendicular or normal to the plane of the container that faces the consumer, such containers have an arcuate perimeter and a visible handle. This handle is usually integrated into the package design. As a result, the handle and the aperture formed between the handle and the body of the package (the "gripping aperture") occupies a significant portion of the facing. This design greatly limits the available area on the facing for graphics, i.e., images and text that are printed or embossed directly on the container or on a film or label affixed to the container. For very large capacity packages, the handle and gripping aperture generally occupy an even larger portion of the facing to allow gripping the handle at different locations or balance points for convenient dispensing as the amount of liquid decreases during use.

Thus, it is desirable to develop a handleware container (i.e., container with a permanently attached handle) for household liquid products that has a significantly larger portion of the facing area available for graphics, yet retains the aesthetic and ergonomic properties suitable for value-added branded consumer products.

A variety of ornamental designs for handleware containers, alternatively known as bottles or jugs, have been the subject of design patents. These include: U.S. Pat. No. D471,465 to Sikra et al issued on Mar. 11, 2003; U.S. Pat. No. D461,717 to Crawford et al issued Aug. 20, 2002; U.S. Pat. No. D329,816 to Beaver et al issued Sep. 29, 1992; U.S. Pat. No. D323,981 to Satterfield issued Feb. 18, 1992; U.S. Pat. No. D303,929 to U.S. Pat. No. D303,929 to Ross issued Oct. 10, 1989; U.S. Pat. No. D221,516 to Crisci issued Aug. 24, 1971; U.S. Pat. No. D212,210 to Anderson issued Sep. 17, 1968; U.S. Pat. No. D210,443 to Mason issued Mar. 12, 1968; U.S. Pat. No. D208,169 to Platt issued Jul. 25, 1967; and U.S. Pat. No. D206,958 to Anderson issued Feb. 14, 1967.

Ways to improve the dispensing properties of large capacity handleware containers for liquid products have also been described in the art. U.S. Pat. No. 3,434,635 issued to Mason Jr. on Mar. 25, 1969 describes a symmetric container of square cross section having a spout and hollow handle that incorporates a channel or spine at the upper surface of the handle as a means of eliminating "glugging". U.S. Pat. No. 5,111,979 issued to Athar on May 12, 1992 discloses a symmetric fluid dispensing container having a large U shaped handle that permits different gripping points, and a pour spout.

The present invention seeks improvements over deficiencies in the known art. Among the one or more problems addressed include a handleware container that has a significantly larger portion of the facing area available for graphics, yet retains the ergonomic and aesthetic properties suitable for added-value consumer products.

SUMMARY OF INVENTION

The inventors have discovered a design for an asymmetric handleware container design in which the front panel effectively masks the gripping aperture when the container is properly oriented on a supermarket shelf. This allows a dramatically increased fraction of the facing area to be utilized for graphics.

Specifically, the handleware container includes a bottom wall panel; vertically oriented front, rear and opposing side wall panels; and a handle joining one of the side panels to form a gripping space; wherein the perimeter of the front wall panel is larger than a perimeter of the rear wall panel; and the gripping aperture is hidden from view by the front wall panel when the container is viewed orthogonal to the front wall panel.

In one suitable embodiment, the front wall panel of the handleware container has a substantially arcuate perimeter and substantially flat and parallel front and rear wall panels.

In another embodiment, a portion of the side panel to which the handle is attached is curved and is asymmetric with respect to a parting line that divides the side wall panel.

In still another embodiment no one wall panel of the container is superimposible on another (i.e., different) wall panel by a symmetry operation or a combination of symmetry operations.

These and other embodiments are described more fully below and in the accompanying drawings.

BRIEF DESCRIPTION OF DRAWING

Further features of the handleware container will now be described in more detail with reference to the drawings in which.

DETAILED DESCRIPTION OF INVENTION

Figure 1:
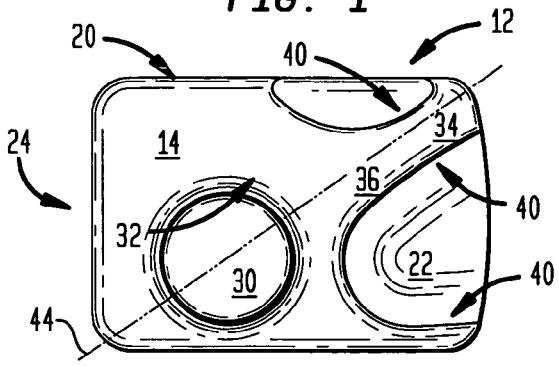
FIG. 1 is a top plan view of a container according to the invention.

For the avoidance of doubt the word "comprising" is intended to mean "including" but not necessarily "consisting of" or "composed of." In other words, the listed steps, options, or alternatives need not be exhaustive.

The handleware containers of the invention can be constructed of any moldable polymeric material such as polyethylene or polypropylene and can include non-polymeric materials. The polymeric material can be of a single layer or it can be a laminate. Examples of suitable packaging materials for construcing the instant container are given in U.S. Pat. No. 6,223,845 to Giblin et al issued May 1, 2001 and the references contained therein and is hereby incorporated by reference in its entirety.

The handleware containers of the invention can be of a range of sizes to hold various volumes of liquids from a fraction of a liter to multi-liters, preferably at least about 2.8 liters, and most preferably at least about 3.7 liters.

Referring now to the drawings in detail, wherein like numerals indicate the same elements throughout the views, there is illustrated a preferred embodiment of the handleware container of the present invention.

Container (or bottle or jug) 12 includes a horizontally orientated top wall panel 14, a horizontally orientated bottom wall panel 16, a vertically orientated front wall panel 18, an and opposing vertically orientated rear wall panel 20, and two opposing vertically orientated side wall panels, 22 and 24. By the term "opposing wall panels" is meant wall panels that are on directly opposite sides of the container but are not necessarily parallel.

The container 12 can be fabricated by any suitable technique such as, for example injection blow molding or extrusion blow molding but other thermoforming techniques can also be used.

The top wall panel 14 has a pour spout opening 30 that is bounded by a cylindrical wall 32 whose external surface 32*a* is preferably threaded to form a boss that accepts an optional cap (not shown). A variety of optional features can be included as part of the pour spout and optional cap. These include, for example, a pour spout fitment with a self-draining feature and/or a measuring cap such as is described in U.S. Pat. No. 4,550,862 to Barker et al issued Nov. 5, 1985 incorporated by reference herein.

Figure 3:
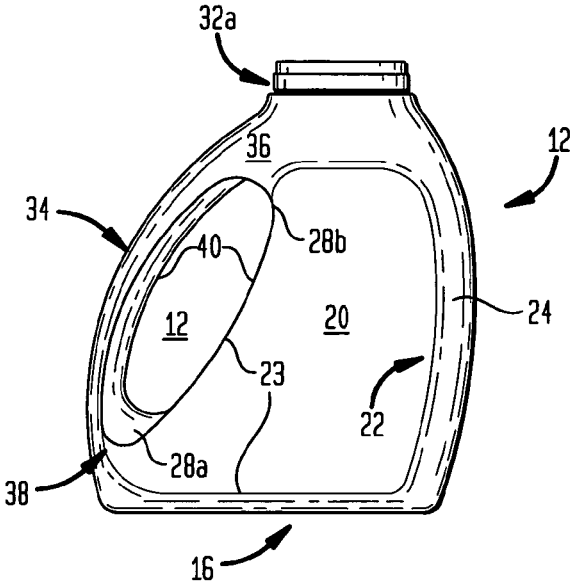
FIG. 3 is a plan view showing a rear panel.
Figure 4:
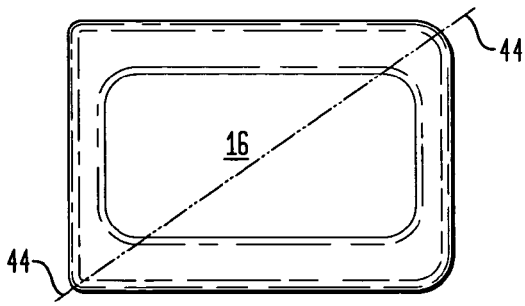
FIG. 4 is a bottom plan view of the container.

The side wall panel 24 although having a curved surface is approximately orthogonal to the front wall panel 18 and the rear wall panel 20 as can be seen from FIG. 1 and FIG. 3 respectively.

With reference to FIG. 1 and FIG. 3 it is seen that the side wall panel 22 is also curved. However, unlike side wall panel 24, the side wall panel 22 is not orthogonal to the front wall panel 18 or the rear wall panel 20 and intersects the plane of the front wall panel 18 at an angle that is less than 90° (approximately 60° in the embodiment depicted in FIG. 1).

A handle 34 overlies the side wall panel 22 and extends from an upper portion 36 adjacent to the top wall panel 14 downwardly and outwardly to a lower portion 38 adjacent to the bottom wall panel 16. The handle 34 is preferably hollow defining an interior space that communicates (i.e., is contiguous) with the interior chamber that is bounded by the interior surface of the bottom 16, top 14, front 18, rear 20 and side 22, 24 wall panels.

Figure 5:
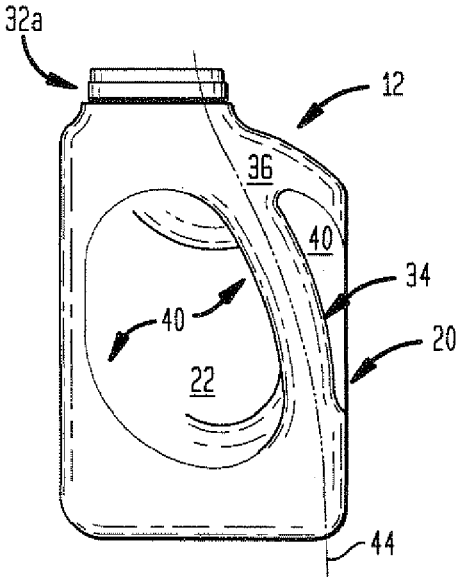
FIG. 5 is a plan view showing a side panel with handle.
Figure 6:
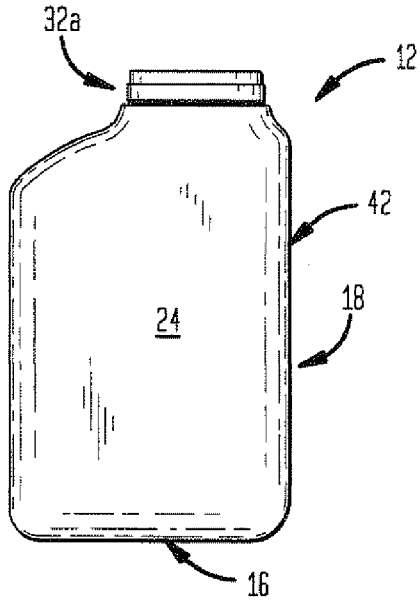
FIG. 6 is a plan view showing a side panel opposite the panel with handle.

The side wall panel 22 and the handle 34 define a "gripping aperture" 40 which accommodates the hand during handling and dispensing operations. This gripping space is best seen in FIG. 1, FIG. 3 and FIG. 5

The front wall panel 18 and the rear wall panel 20 are preferably predominantly planar. By the term predominantly planer is meant that the fraction of the total surface area occupied by the planar section should be greater than 50%, preferably greater than 75%, and most preferably greater that 85%. However, the term "planar" should be understood as "approximately or predominantly planar" in the practical sense used in the context of the art of packaging for liquids. Thus, front and rear wall panels 18 and 20 respectively) may bow out slightly especially when the container is filled. The extent of bowing depends on the flexibility of the polymeric material used to fabricate the container. Such bowed panel walls are classified as both planar and parallel in the present context.

Figure 2:
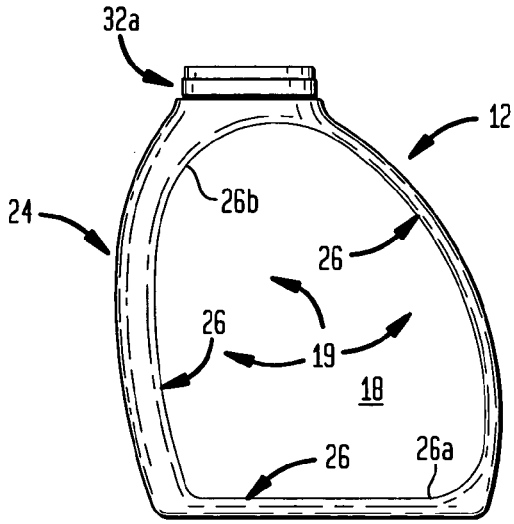
FIG. 2 is a plan view showing a front panel of the container.

As shown best in FIG. 2, the front panel has a planar portion 19 that is bounded by a perimeter 26 that preferably has one or more arcuate segments such as the generally vertically directed segment 26*a*–26*b*.

As shown in FIG. 3, the rear panel 20 is bounded by a perimeter 28 that can also include an arcuate segment such as the generally vertically directed segment 28*a*–28*b*.

As shown in FIG. 2, a key feature of the instant handleware container is that the surface area of the front wall panel 18 is larger than the surface area of the rear wall panel 20. This asymmetric design and the diagonal location of the handle 34 (discussed further below) allows the front wall panel to hide the gripping aperture 40 from view when the container 12 is viewed orthogonal to the front wall panel 18 as shown in FIG. 2. One of the advantages of the instant asymmetric design is the substantial increase in the surface area on the facing of the container 12 that is now available for graphics.

Figure 7:
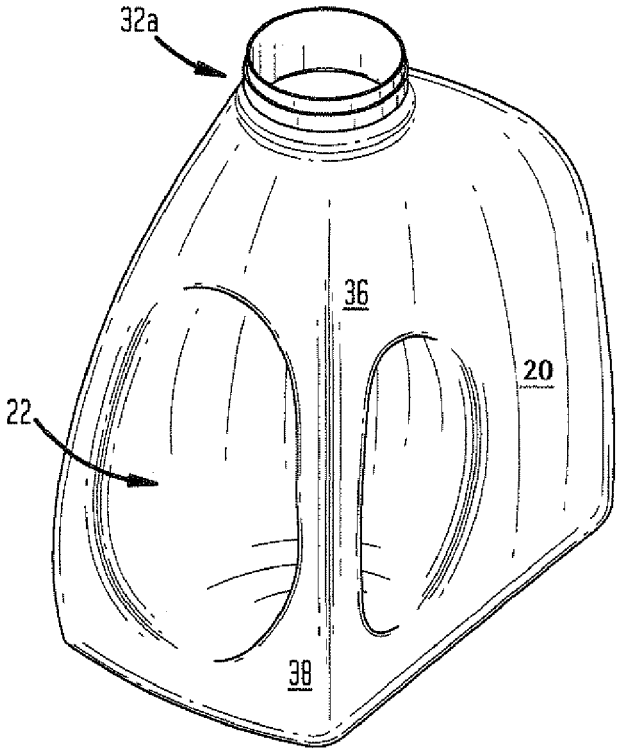
FIG. 7 is a diagonal perspective of the container.

In the current embodiment of the inventive handleware container 12 shown in FIG. 1 and FIG. 7, the handle 34, spout 30, and base panel wall 16 are bisected by a diagonal plane that is orthogonal to the bottom wall panel. The intersection of this diagonal plane with the top wall panel 14, the base wall panel 16, the side wall panels 22, the handle 34 and the edge 42 (adjacent to the front wall panel 18 and the sidewall panel 24) forms a reference line called the "parting line" 44 shown schematically in FIG. 7. This parting line 44 generally is the seam that is formed between separately blow-molded sections of the container.

A further embodiment of the inventive handleware container shown in FIG. 1, FIG. 3, and FIG. 5 is that the side wall panel 22 is asymmetric with respect to the parting line 44 (is not divided into halves that mirror images). This asymmetry provides a visible and larger gripping aperture 40 when the container is viewed from the side i.e., along the lines 4—4 in FIG. 1. This view is shown in FIG. 5.

A further additional feature of the preferred embodiment is seen from FIGS. 1–6. Namely, that none of the wall panels 14, 16, 18, 20, 22, and 24 are superimposible. By not superimposible is meant that no one wall panel can be made congruent with another wall panel by a symmetry operation such as a rotation about an axis, or by reflection through either a point or a plane or by any combination of symmetry operations.

It should be understood, of course that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A handleware container comprising a bottom wall panel; vertically oriented front, rear and opposing side wall panels; and a handle affixed to one of the side wall panels to form a gripping aperture; wherein the surface area of the front wall panel is larger than the surface area of the rear wall panel; wherein the gripping aperture is hidden from view by the front wall panel when the container is viewed orthogonal to the front wall panel and wherein none of the wall panels are superimposible.

2. The handleware container according to claim 1 wherein the front wall panel has a substantially arcuate perimeter.

3. The handleware container according to claim 1 wherein the front wall panel and rear wall panel is predominantly planar and parallel.

4. The handleware container according to claim 1 wherein the side wall panel to which the handle is attached is asymmetric with respect to a parting line.

5. The handleware container according to claim 1 wherein a portion of the gripping aperture is visible when the container is viewed from the side wall panel to which the handle is affixed.

* * * * *